United States Patent [19]

Darda

[11] Patent Number: 4,832,156

[45] Date of Patent: May 23, 1989

[54] SPRING MOTOR

[76] Inventor: Helmut Darda, 7712 Blumberg, Fed. Rep. of Germany

[21] Appl. No.: 149,448

[22] Filed: Jan. 28, 1988

[30] Foreign Application Priority Data

Jan. 28, 1987 [DE] Fed. Rep. of Germany ..... 3702457

[51] Int. Cl.[4] ..... F03G 1/06; F16H 27/00; G04B 15/12

[52] U.S. Cl. ..... 185/38; 74/1.5; 185/DIG. 1; 368/134; 368/181; 446/464

[58] Field of Search ..... 74/1.5; 185/5, 31, 38, 185/DIG. 1; 368/124, 125, 134, 137, 181, 138; 446/464

[56] References Cited

U.S. PATENT DOCUMENTS

| | | | |
|---|---|---|---|
| 638,745 | 12/1899 | Newell | 368/138 |
| 1,130,435 | 3/1915 | Ross | 368/181 |
| 3,812,933 | 5/1974 | Darda | 185/37 |
| 3,981,098 | 9/1976 | Darda | 185/37 X |
| 4,053,029 | 10/1977 | Darda | 185/39 |
| 4,106,282 | 8/1978 | Larsson | 74/1.5 X |
| 4,715,475 | 12/1987 | Minoru | 185/38 X |

FOREIGN PATENT DOCUMENTS

| | | |
|---|---|---|
| 376510 | 5/1923 | Fed. Rep. of Germany . |
| 867351 | 2/1953 | Fed. Rep. of Germany . |
| 2166490 | 10/1974 | Fed. Rep. of Germany . |
| 2166888 | 7/1976 | Fed. Rep. of Germany . |

*Primary Examiner*—Allan D. Herrmann
*Attorney, Agent, or Firm*—Irvin A. Lavine

[57] ABSTRACT

A braking device is provided to reduce the speed at which a shiftable spring motor runs down. The braking device includes a pallet which is mounted so that it can oscillate, the pallet having a pair or arms which cooperate with the teeth of an escape wheel 13 which rotates as the spring runs down. The pallet is connected to a pendulum weight. The depth of engagement of the arms of the pallet in the teeth of the escape wheel as well as the amplitude of oscillation of the pallet and/or the pendulum weight connected therewith allow the braking action to be changed and hence the speed at which the motor runs down in one of a plurality of selectable shift positions.

6 Claims, 9 Drawing Sheets

31
35
35a
43g
34
51
32
43f
43e
34c
34b
34a
43d
43c
43b
43a
40
46
41
60
64
63
62
42
45
65
44b
20
44a
13
25
26
24
32
20
23
22
21

31
Z
35
35a
43g
43f
24
44b
45
65
44a
51
32
46
41
60
40
64
63
42
62
13
20
21

Z
31
46
44b
65
44a
51
32
41
34a
43b
60
40
64
63
42
62
13
13a
26
25
20

31
Z
35
35a
43e
46
44b
44a
65
51
40
60
64
63
62
42
24
13
20
32
23
21

31
35
46
65
Z
51
34b
43a
40
60
13
13a
26
24
20
64
32
41
63
62

SPRING MOTOR

BACKGROUND OF THE INVENTION

The invention relates to a spring motor whose function is essentially described in U.S. Pat. No. 2,812,933, corresponding to German Patents 2 019 085 and 2 039 265; U.S. Pat. No. 3,981,098, which includes also the disclosure of German Patent 21 05 734, and to U.S. Pat. No. 4,053,029 which includes subject matter of German Patent 21 66 490 and whose especially preferred embodiment is described in German Patent 24 61 625, said patents relating to inventions by the same applicant.

Spring motors of this type are preferably used in very small toy cars because of their compact design.

These spring motors have a comparatively simply designed differential transmission, especially suitable for driving fast-moving toy cars.

The goal of the present invention is to modify and/or improve upon this motor in such fashion that it is also suitable for driving slow-moving toy cars or can be simply adapted to toy cars with modified dimensions or weights.

German Patent 21 66 888 has proposed providing an additional step-down transmission in a toy car of the same species, between the drive shaft of the spring motor itself and the drive shaft of the car, in order to reduce the traveling speed thereby.

Although this solution is feasible, it is unsuitable for economically priced small toy cars if this transmission is also to be shiftable.

Moreover, this step-down transmission cannot be integrated into the spring motor disclosed in U.S. Pat. No. 4,053,029 and in German Patent 24 61 625 without a significant change.

SUMMARY OF THE INVENTION

To achieve the above goal, the influence on the speed is not accomplished by reducing the rotational speed of the drive shaft in known fashion by using a shiftable step-down transmission, but by employing an adjustable braking device which influences the speed at which the spring motor winds down. Braking devices used in clockmaking are suitable, in which devices the drive shaft of the spring motor is connected to a shift or escape wheel, which cooperates with a pallet mounted so that it oscillates, the arms of said pallet alternately engaging the teeth of the escape wheel.

By changing the braking action, for example, by changing the depth of engagement of the pallet and the escape wheel, the speed at which the motor runs down can be regulated continuously over a set range.

This has previously been described in German Patent 376 510 in conjunction with a clock movement and in German Patent 867 351 in connection with a drive for a film camera.

It has been found that a braking device of this kind cannot sufficiently reduce the speed of a spring-driven toy car.

To achieve the stated goal, an engageable braking device is proposed according the invention for a spring motor including a coil spring which may be brought into driving relationship with a drive shaft through a transmission. The basic objective of the proposed solution is to change the oscillation amplitude of a pallet which cooperating with an escape wheel.

This permits relatively large shifting stages, so that by simple means, including staggered stops of the sides of the pallet associated with adjustable stops, clear shift positions, like the speeds of a shifting transmission of motor vehicles, can be achieved.

According to another object, the braking device according to the invention can be combined with a known braking device, used in clock movements and camera drives, providing additional possible variations.

It is advantageous for the designer who must provide toy cars having very different dimensions with a spring motor of the kind disclosed to be able to adjust the characteristics of the spring motor to the toy car without significant changes.

This purpose is served by mounting the pallet so that it can oscillate, and is additionally provided with a pendulum weight which is preferably fastened loosely and interchangeably to a pendulum. By replacing the pendulum weight which oscillates in the direction of travel of the toy car, the direction of travel of the free-running, i.e. not track-bound, vehicle can be influenced, something which is necessary for example if the direction of travel deviates undesirably from a straight line.

The invention as well as additional measures for working the invention are explained below with reference to an embodiment in detail with reference to the drawings.

DETAILED DESCRIPTION OF THE INVENTION

Figures 5, 5A:
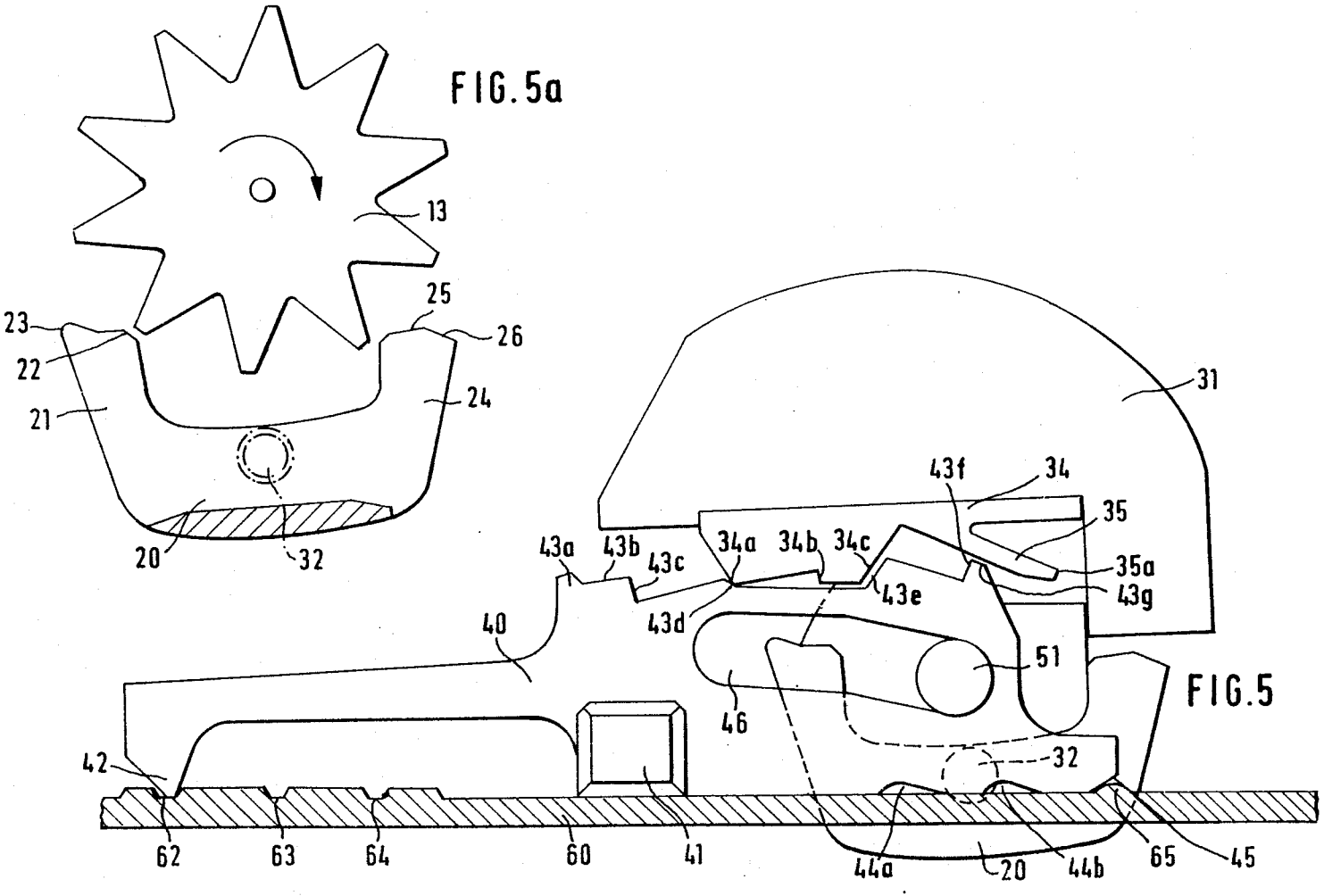
FIGS. 5–9 are schematic side views of the spring motor looking in the direction V—V in FIG. 1 with a sectioned bottom plate, showing the different shifting and oscillating positions of the braking device according to the invention.
Figures 6, 6A:
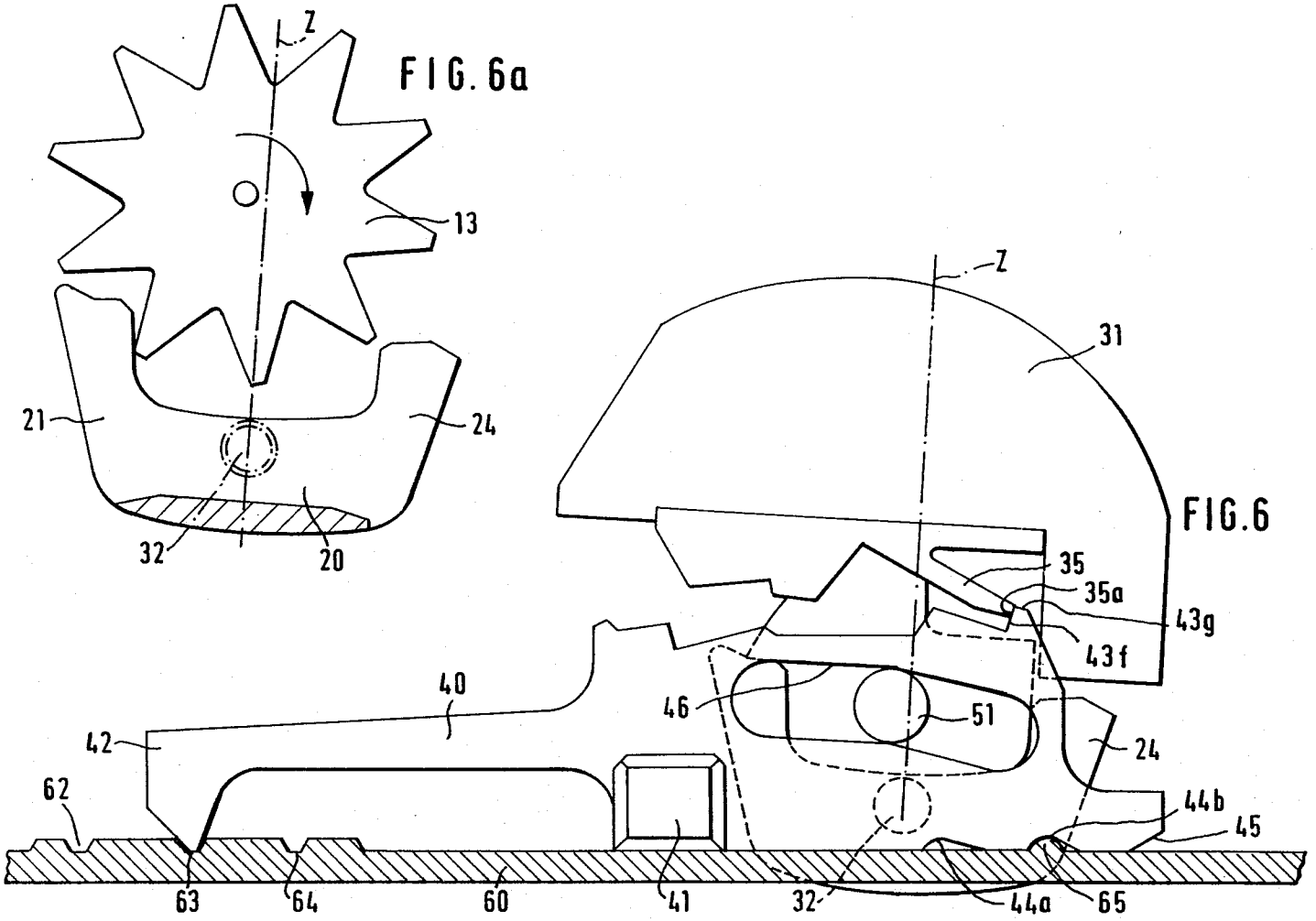
Figures 7, 7A:
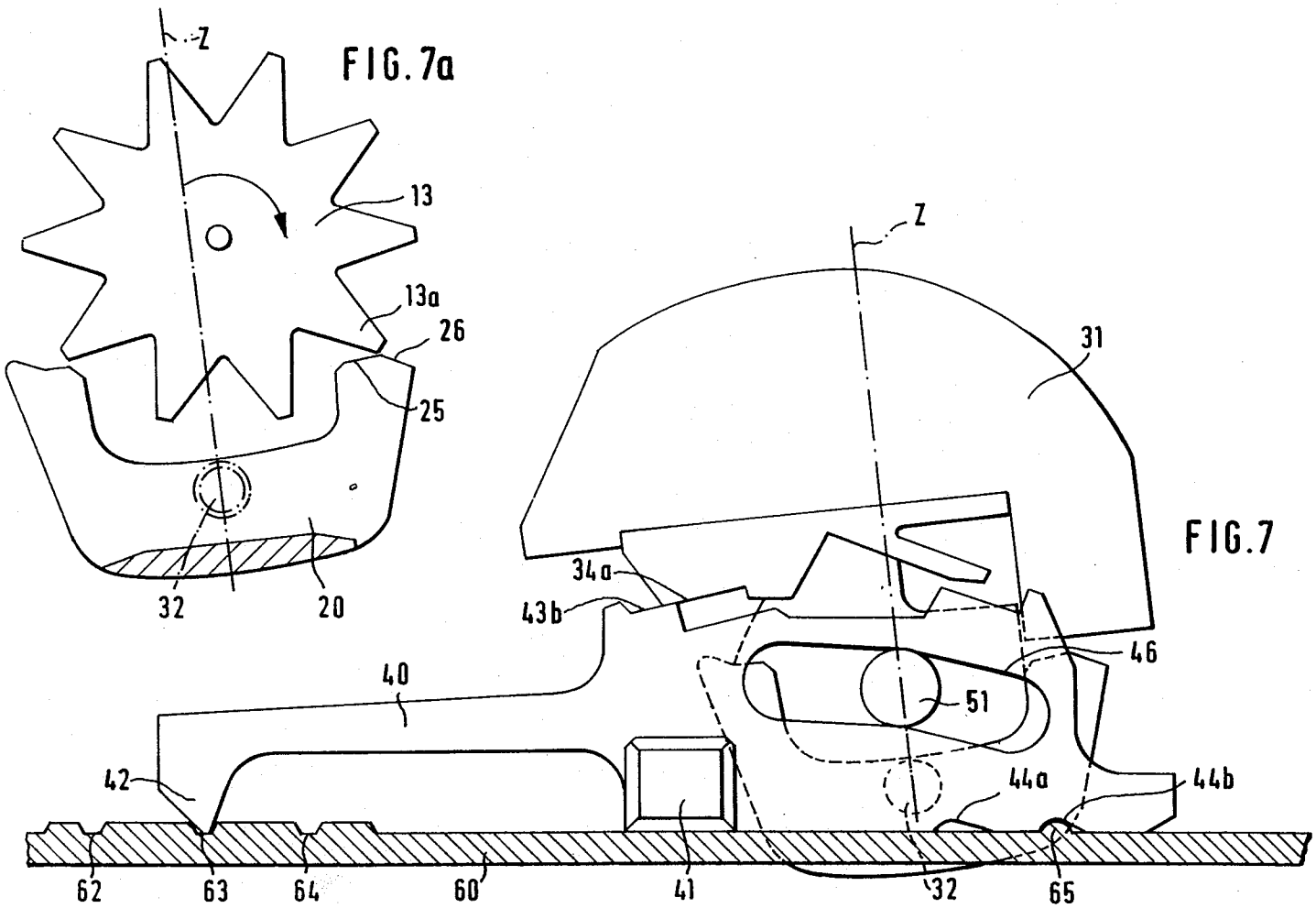
Figures 8, 8A:
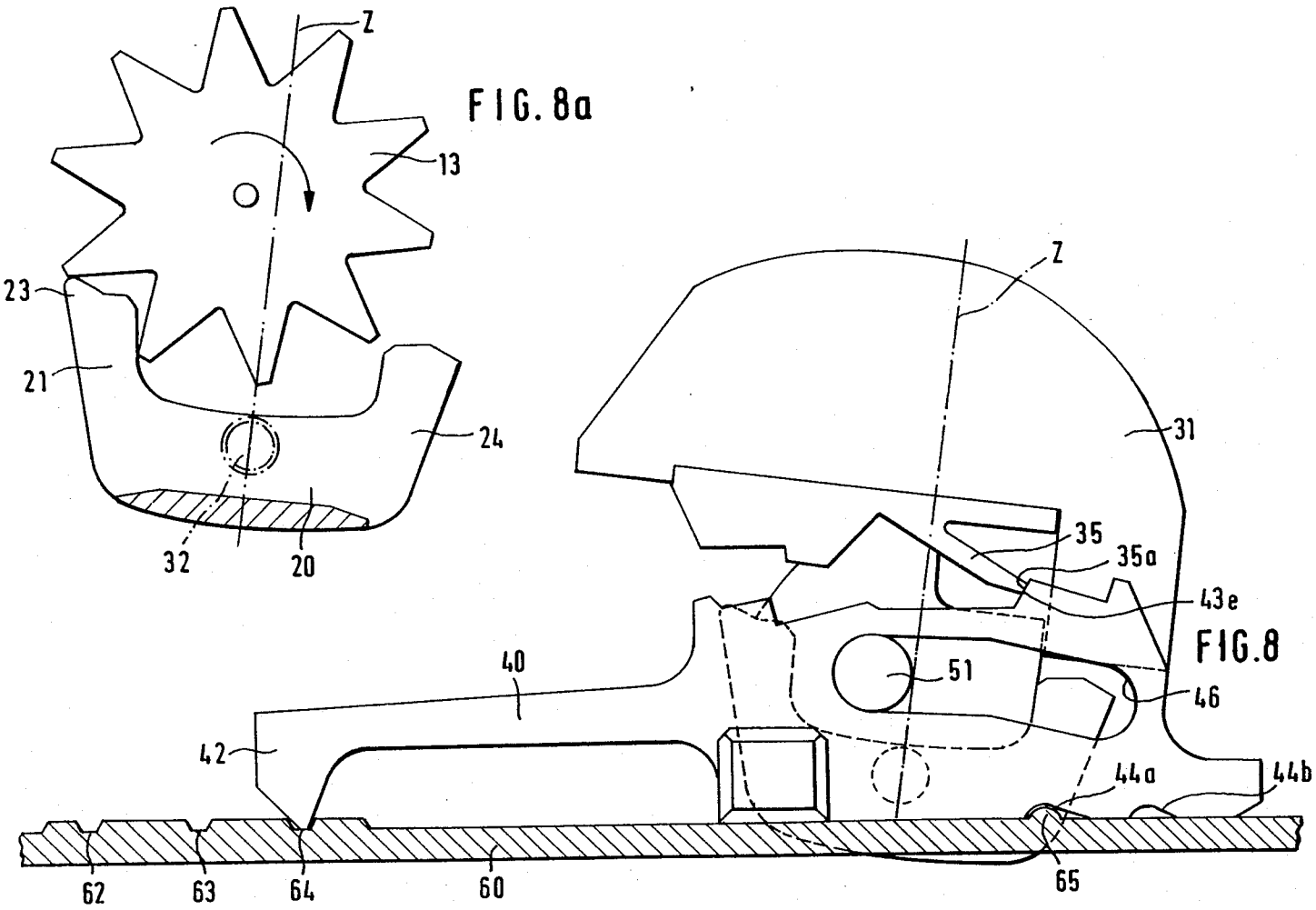
Figures 9, 9A:
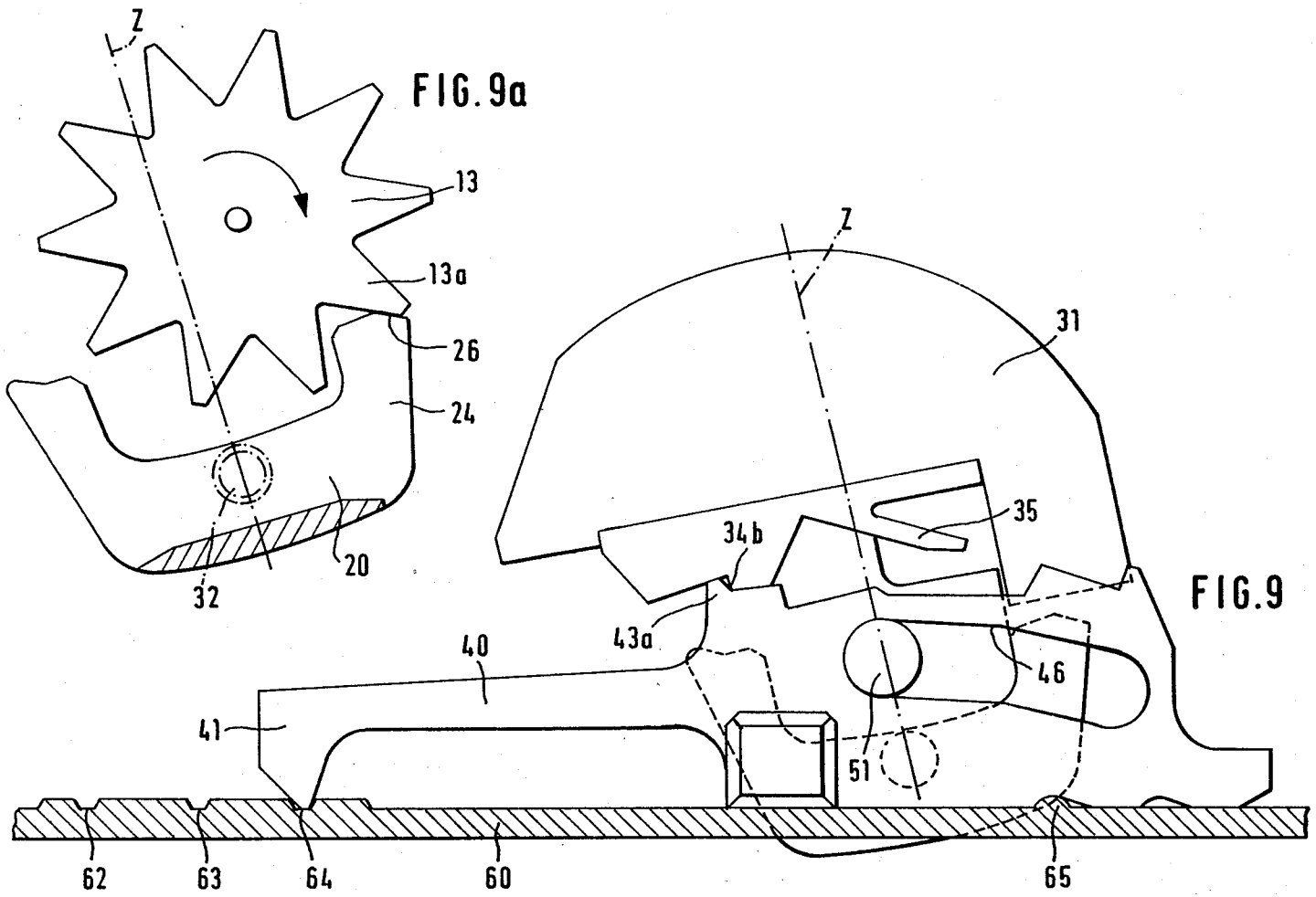

FIGS. 5*a* to 9*a* are side elevations of the escape wheel and pallet in the positions corresponding to the shifting or oscillating positions shown in FIGS. 5–9; in particular:

FIGS. 5, 5*a* show the braking device in neutral (first shaft position);

FIGS. 6, 6*a* show the braking device with a slight braking action (second shift position), with the pallet and the pendulum at the right-hand extreme of oscillation;

FIGS. 7 and 7*a* show the braking device according to FIG. 6 (second shift position) with the pallet and the pendulum at the left-hand extreme of oscillation;

FIGS. 8 and 8*a* show the braking device with its maximum braking action (third shift position), with the pallet and the pendulum at the right-hand extreme of oscillation; and FIGS. 9 and 9*a* show the braking device according to FIG. 8 (third shift position), with the pallet and pendulum at the left-hand extreme of oscillation.

DETAILED DESCRIPTION OF THE DRAWINGS

The basic design of the spring motor whose operation is described in detail in the patent cited at the outset is as follows.

Figure 1:
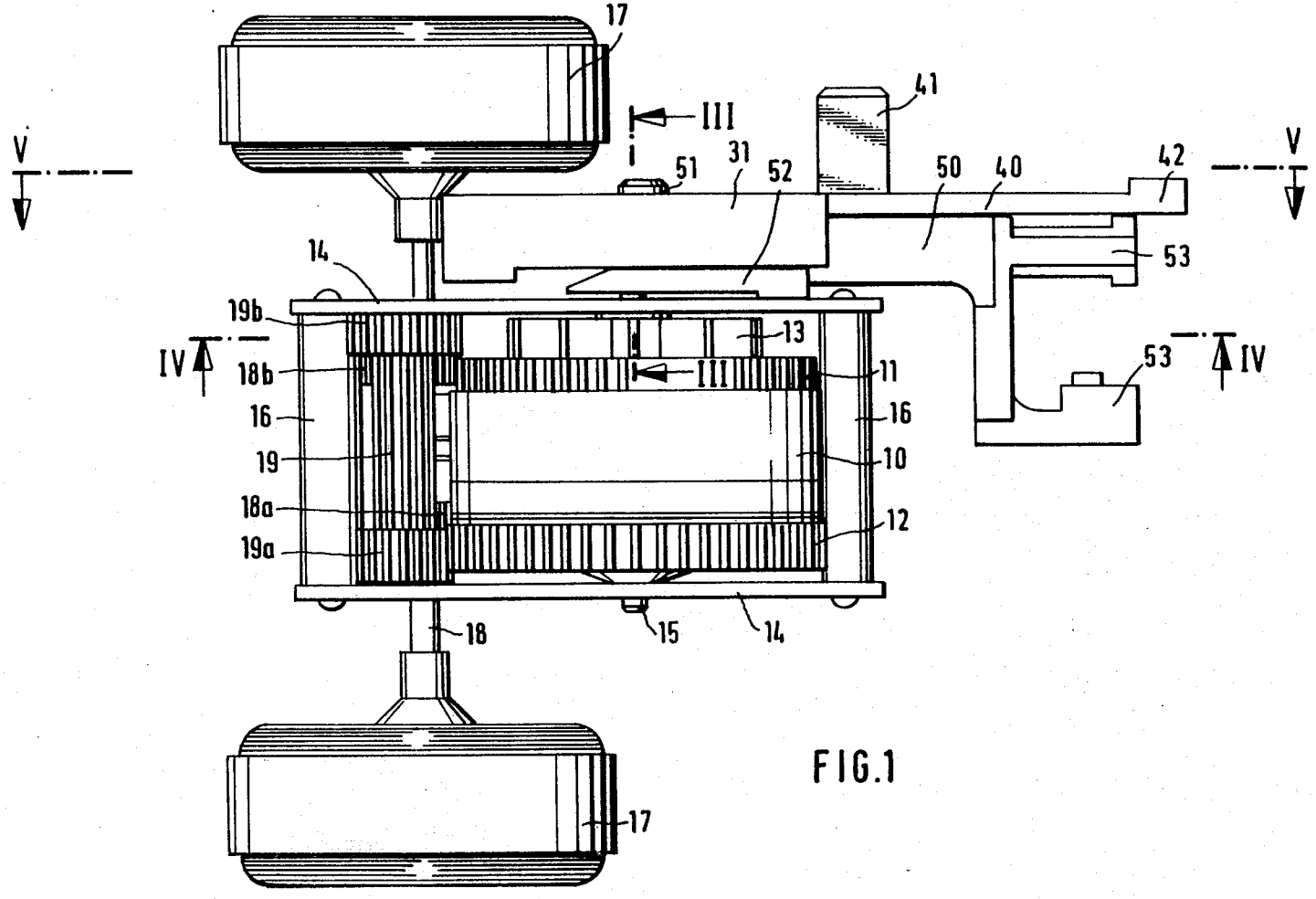
FIG. 1 is a top view of the entire spring motor according to the invention.
Figure 2:
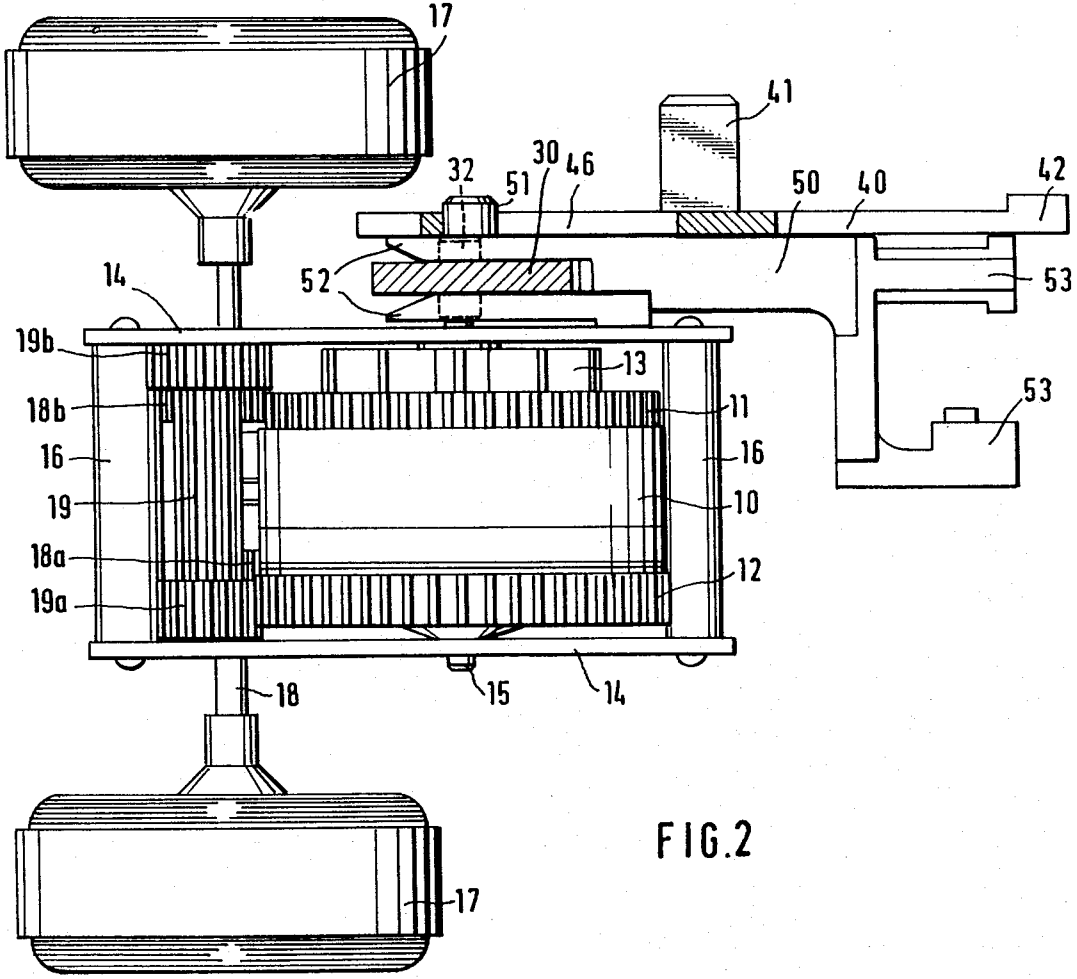
FIG. 2 is a top view of the spring motor according to FIG. 1, but showing the parts cut along line II—II in FIG. 3.

In FIG. 1, a spring, not shown, is located in a closed spring housing 10, the ends of said spring being connected at one end to spring housing gear 11 and at the other end to spring core gear 12.

Gears 11 and 12, rotating in opposite directions, are connected in driving fashion with one another by means of a so-called reversing pinion 19 which comprises pinions 19*a* and 19*b* rigidly connected with one another, and drive pinions 18*a* and 18*b* mounted on axle 18, in such fashion that a torque is exerted on axle 18 which corresponds to the difference in the torque delivered by gears 11 and 12. The arrangement of the gears is also such that the spring located in spring housing 10 is tensioned at a certain shift position by rotating axle 18 in both directions from the inner and outer ends simultaneously.

The parts of this spring motor known from the patents listed at the outset are mounted between motor plates 14 connected together by support 16. The complete drive is pivotably mounted on bottom plate 60 by means of support 16 (at the right in FIG. 1) which is located at the front, looking in the direction of travel. Spring housing 10 with gears 11 and 12 is rotatably mounted by means of its shaft 15 between plates 14.

The device according to the invention slows down the rate at which the spring motor runs down, with the degree of retardation being adjustable.

This is acomplished by the braking mechanism according to the invention which consists of an escape wheel 13 permanently attached to spring housing gear 11 and a pallet 20 cooperating therewith (see FIGS. 3 and 4), said pallet in turn being connected by part 33 and pendulum 30 with pendulum weight 31.

Pendulum 30 is mounted so that it can oscillate by means of pendulum axis 32 between arms 52 of a pendulum fork 50. Pendulum fork 50 itself is permanently attached by anchoring arms 53 to bottom plates 60. It is however, deflectable to a limited extent perpendicularly to the bottom plate by means of control pin 51, due to its elasticity. This goal is accomplished by adjusting slide 40 which is displaceably mounted so that it can be moved by means of adjusting lever 41 along bottom plate 60. A control cam 46, the exact construction of which is shown in FIGS. 5–9, it fits around control pin 51 of pendulum fork 50. The shape of control cam 46 is such that arm 52 of pendulum fork 50 and hence pendulum axis 32, when adjusting slide 40 is adjusted, are raised out of the position shown in FIG. 5 through those shown in FIGS. 5 and 6 and into that shown in FIGS. 8 and 9, with pallet 20 with its arms 21, 24 being brought increasingly into mesh with the teeth of escape wheel 13, as is shown in detail in FIGS. 5*a* to 9*a*.

Figure 3:
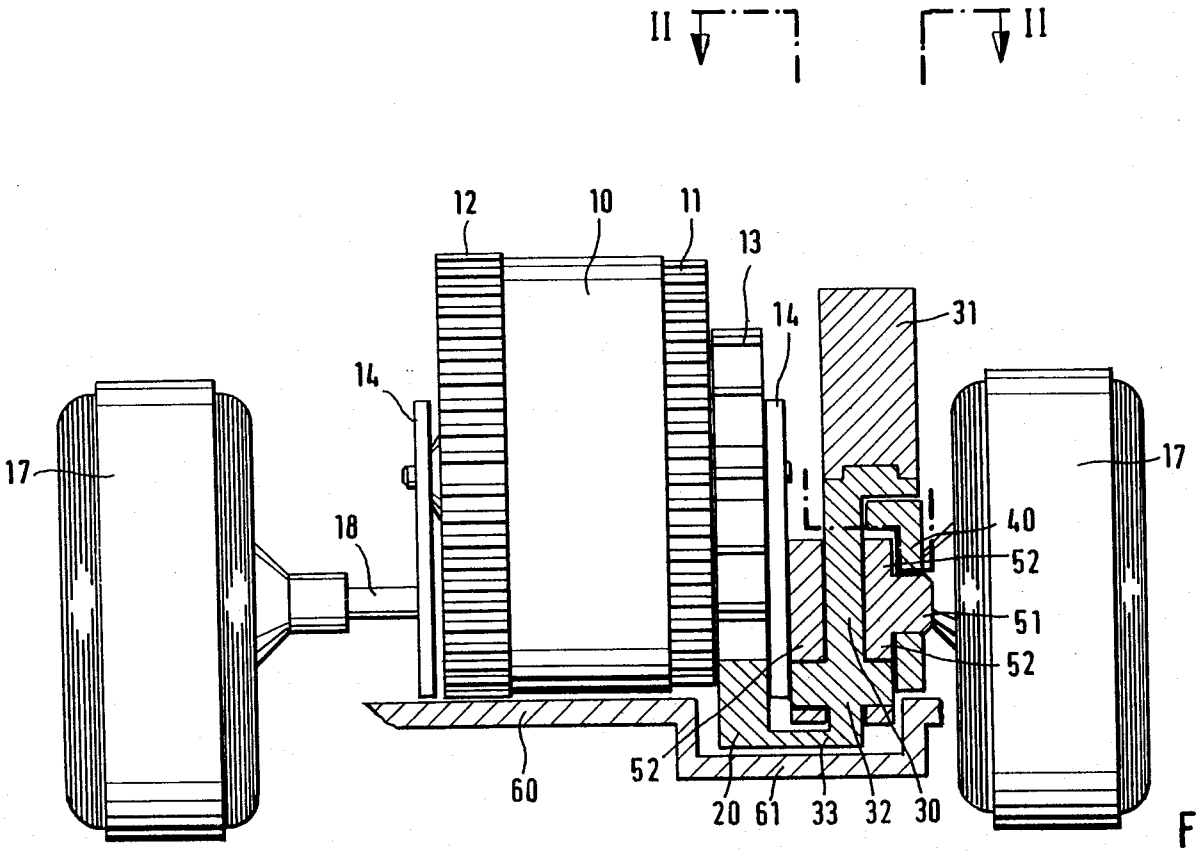
FIG. 3 is a front elevation of the spring motor according to FIG. 1, but with the sectional view shown in FIG. 1 along line III—III.
Figure 4:
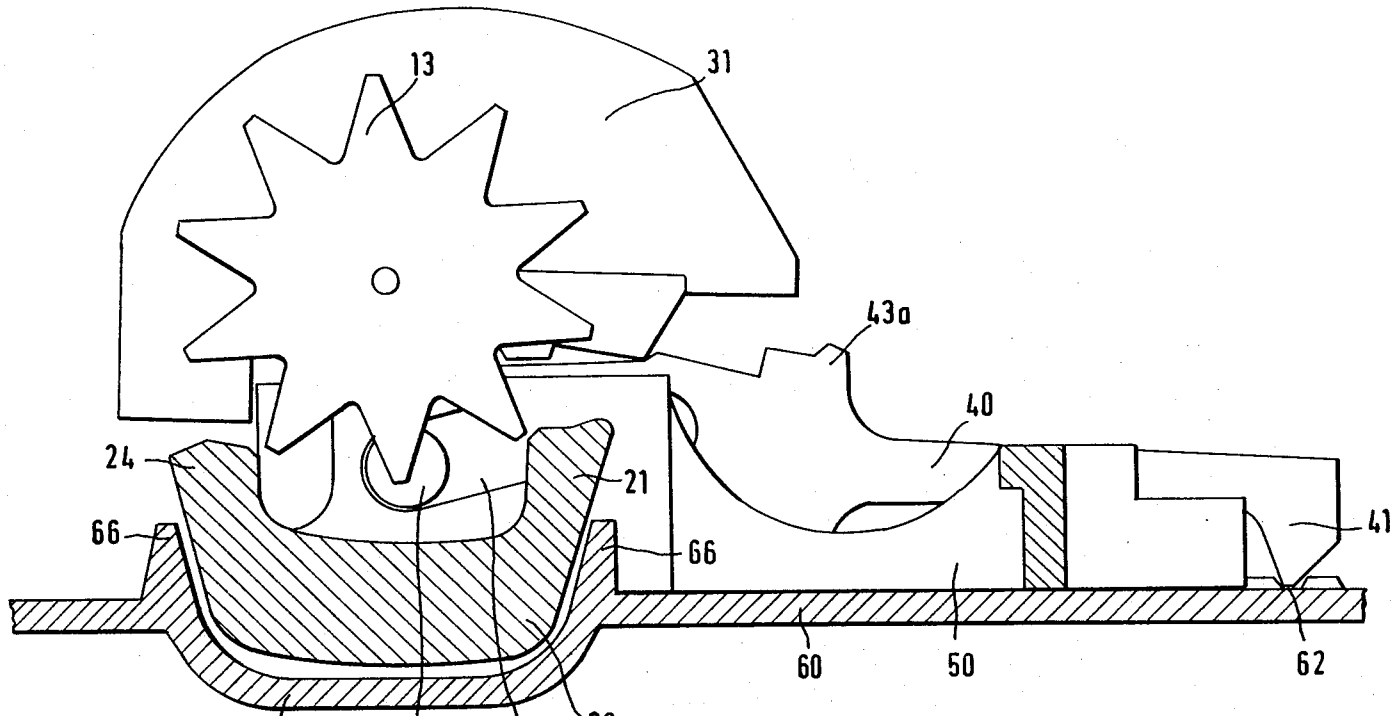
FIG. 4 is an enlarged cross section through the spring motor according to FIG. 1 along line IV—IV with an escape wheel shown not cut.

It is evident from FIGS. 3 and 4 that the lower area of pallet 20 and pendulum 30 as well as the connecting part 33 between them are mounted in a trough 61 whose edges 66, located at the front and rear looking in the direction of travel, are raised above the surface of bottom plate 60.

These trough edges 66 serve primarily to limit the oscillating motion of pallet 20 especially at its uppermost position in order to prevent jamming between arms 21 and 24 on the one hand and escape wheel 13 on the other, which could lead to complete jamming of the spring motor or at least a non-uniform influence on the rate at which the spring motor runs down.

The exact function of the braking device according to the invention is shown in FIGS. 5–9.

FIG. 5 shows the braking device in its first shift position in which adjusting slide 40 has a locking nose 42 engaging a first notch 62 and bottom plate 60. To further ensure that it remains in this position, the stop surface 45 which is located on the right-hand side of the adjusting slide abuts a projection 65 on the bottom plate.

The top of adjusting slide 40 is equipped with a number of stops 43*a* to 43*f* which limit the oscillation amplitude of pendulum weight 31. For this purpose, a stop part with stops 34*a, b, c,* as well as 35*a* is provided below pendulum weight 31, said stops being mounted on the underside of pendulum part 34, and therefore connected to pendulum weight 31 and cooperating with above-mentioned stops 43*a* to *f* in the various shift and oscillation positions.

In the shift position according to FIG. 5, pendulum weight 31 rests with its part 34 against stops 43*d,* 43*e,* and 43*g* in such fashion that the pendulum cannot move. In addition, pallet 20, as indicated primarily in FIG. 5*a,* is lowered to the point where it cannot engage escape wheel 13 which rotates in the direction indicated by the arrow as the spring runs down.

Pallet 20, pendulum 30, and pendulum weight 31 are dimensioned and mounted in such fashion that pallet 20 is pivoted slightly counterclockwise relative to the horizontal position so that the arrangement shown in this embodiment ensures that the teeth of escape wheel 13 do not touch arms 21 and 24 of pallet 20. Pallet 20 with pendulum 30 is held in this position since pendulum fork 50, in which pendulum axis 32 is mounted, is held in the lowermost position by means of the right-hand part of control cam 46 and of control pin 51 which is located in the latter.

FIGS. 6 and 6*a* show the braking device in a second shift position.

To reach this shift position, adjusting slide 40 is slid toward the right out of the position shown in FIG. 5 until its locking nose 42 engages second notch 63 and its notch 44*b* engages projection 65. By virtue of this displacement, pendulum fork 50, which engages control cam 46 by its control pin 51, is lifted out of the lower position into the middle position.

In this middle position, as FIG. 6*a* shows more clearly, pallet 20 engages escape wheel 13. When escape wheel 13 rotates clockwise, one of its teeth moves along the inside of arm 21 and tilts the latter, bringing pendulum 30 with pendulum weight 31 into the position shown in FIGS. 7 and 7*a*.

As FIGS. 6 and 7 show, the oscillation amplitude of the pendulum is limited by the fact that on the one hand it strikes (by means of stop 85*a* on tongue 35) stop 43*f* of adjusting slide 40 (see FIG. 6) and on the other hand (with stop 34*a*) it strikes stop 43*b* of adjusting slide 40 (see FIG. 7). In the position shown in FIGS. 7 and 7*a,* escape wheel 13 has one of its teeth 13*a* moving along the contact surface 25 of pallet 20 which slopes inward relative to pallet 20. Since the tip of tooth 13*a* strikes contact surface 25 of pallet 20 at an acute angle, escape wheel 13 can swing pallet 20 away with less force.

The end position in which the braking device according to the invention exert its maximum braking action is shown in FIGS. 8 and 9.

In order to reach this position, adjusting slide 40 must be slid all the way to the right until its locking nose 42 engages third notch 64 and its notch 44*a* engages projection 65, locking the slide 40 in the end position.

By means of control cam 46 and control pin 41 cooperating therewith, pendulum weight 30 with pallet 20 and pendulum 31 is raised further in the manner described above, so that the depth of engagement of arms 21 and 24 in the teeth of escape wheel 13 is increased to its maximum.

At the same time, the arrangement of the stops on adjusting slide 40 and pendulum 30 is changed in such fashion that pendulum 30 reaches maximum oscillation amplitude with pendulum weight 31. Thus, pendulum 30, in its right-hand position shown in FIG. 8, with the stop surface 35*a* at the front on tongue 35, strikes stop 43*e* of the adjusting slide 40 and, in its left-hand position shown in FIG. 9, strikes stop 43*a* of adjusting slide 40 with its stop 34*b*. As is shown clearly by the dot-dashed lines of symmetry Z of the pendulum, this increases the amplitude of the oscillations to the maximum extent, which necessarily leads to a slowing of the motion of the pendulum 30 and hence of the rotational speed of escape wheel 13 connected to spring gear 11.

In order to avoid undesirable jamming of escape wheel 13 in this position, arm 21 is provided with a projecting nose 23, which limits the depth of penetration in cooperation with the inner surface of arm 21. If arm 21 were to penetrate further into the space between the teeth, it could result in a complete stoppage of escape wheel 13 or at least to non-uniform braking and hence to irregular running down of the spring motor.

In the left-hand oscillation position shown in FIG. 9, in contrast to the position shown in FIGS. 7 and 7*a*, tooth 13*a* of escape wheel 13 strikes surface 26 of arm 24 which slopes outward, and at an obtuse angle. As a result, in this position the friction between pallet 20 and escape wheel 13 is increased relative to the friction of the arrangement shown in FIG. 7*a*, resulting in a further increase in the braking action, hence reducing the rate at which the motor runs down.

According to another construction of the invention, oscillating weight 31, preferably made of metal, is releasably connected with pendulum 30. This offers the opportunity to change the braking action by replacing the pendulum weight, so that the spring motor, otherwise unchanged, can be used to drive toy cars of different weights or of different designs. This is of great importance for efficient manufacture.

It is also significant that the braking device according to the invention can be installed with a minor change of the spring motor during manufacture for example, according to the disclosure in U.S. Pat. No. 4,053,029, and German Patent 24 61 625. In this spring motor, described and shown in these patents, it is merely necessary to replace the purely decorative stops which are located on spring gear 1a by escape wheel 13 and to supplement this spring motor subsequently with the braking device according to the invention consisting of pallet 20, pendulum 30, adjusting slide 40, and pendulum fork 50, and only slight changes to the bottom plate 60 will be required.

In this way, the invention can be used with the known spring motor by simple and economical measures.

One advantageous side effect of the braking action according to the invention is that it creates a noise as the spring motor runs down which resembles the sound of a motor, increasing the attractiveness of the toy car for children.

I claim:

1. A spring motor comprising:

(a) a drive shaft, and (b) means for braking said drive shaft comprising:

i. an escape wheel mounted on said drive shaft, said wheel having teeth, ii. a pallet, iii. means for mounting said pallet on a pendulum axis for oscillatory movement about said pendulum axis, iv. means on said pallet comprising at least one arm for alternately engaging the teeth of said escape wheel, v. a pendulum weight and a pendulum part connected to said pallet, and stops on said pendulum part located in staggered position in the direction of oscillation, and vi. means for adjusting the oscillation amplitude of said pallet comprising stops thereon matching said stops on said pendulum part.

2. The spring motor of claim 1, wherein said means for adjusting the oscillation amplitude includes an adjusting slide, means for enabling displacement of said slide transversely of said pendulum axis, said adjusting slide having a control cam, and means for engaging said cam to increase or decrease the oscillation amplitude when said adjusting slide is displaced comprising a pendulum fork having a control pin engaging said cam.

3. The spring motor of claim 2 wherein the adjusting slide has a locking nose, and further including a bottom plate for supporting the spring motor, said bottom plate having notches thereon positioned for engagement by said locking nose when said adjusting slide is displaced.

4. The spring motor of claim 2, wherein the adjusting slide has at least one notch therein, and said bottom plate has at least one projection to engage said notch when said adjusting slide is displaced.

5. The spring motor of claim 3, and means for adjusting the depth of engagement of said pallet arm relative to the escape wheel, and hence the braking action of the braking device.

6. The spring motor of claim 5, further including means for supporting the escape wheel in a fixed position relative to the motor, and means for mounting the pallet for oscillation in the pendulum fork.

* * * * *